US007643647B2

(12) United States Patent
Lowell et al.

(10) Patent No.: US 7,643,647 B2
(45) **Date of Patent: *Jan. 5, 2010**

(54) LAY-IN TILE SPEAKER SYSTEM

(75) Inventors: Wilhelm R. Lowell, St. Louis, MO (US); Jeffrey R. Garstick, Ballwin, MO (US); Carey C. Porter, Beaufort, MO (US); Daryl Schoolfield, High Ridge, MO (US)

(73) Assignee: Lowell Manufacturing Company, Pacific, MO (US)

( * ) Notice: Subject to any disclaimer, the term of this patent is extended or adjusted under 35 U.S.C. 154(b) by 1142 days.

This patent is subject to a terminal disclaimer.

(21) Appl. No.: 11/075,223

(22) Filed: Mar. 8, 2005

(65) Prior Publication Data

US 2005/0204667 A1 Sep. 22, 2005

Related U.S. Application Data

(63) Continuation-in-part of application No. 09/972,465, filed on Oct. 5, 2001, now Pat. No. 7,120,269.

(51) Int. Cl.
*H04R 1/02* (2006.01)

(52) U.S. Cl. ..... 381/386; 381/396; 381/87; 181/171

(58) Field of Classification Search ..... 52/415, 52/279, 631; 381/396, 395, 386, 150, 171, 381/87, 391, 394, 332, 333, 334, 335, 336; 181/171, 148, 150; 428/603, 130, 121
See application file for complete search history.

(56) References Cited

U.S. PATENT DOCUMENTS 1,726,500 A * 8/1929 Norris ..... 52/145
1,992,509 A * 2/1935 Slidell ..... 52/145
1,998,425 A * 4/1935 McNeil ..... 52/145
2,662,743 A 12/1953 Frenger
2,830,330 A 4/1958 Heath
2,924,856 A * 2/1960 Price ..... 52/144
3,666,040 A 5/1972 Junk
3,912,865 A 10/1975 Seebinger (Continued)

OTHER PUBLICATIONS

Quam-Nichols Co.; The TR Lay-in Speaker System from Quam; Web site pages, 2001.

(Continued)

*Primary Examiner*—Vivian Chin
*Assistant Examiner*—Con P Tran

(57) ABSTRACT

A speaker support system is adapted for use in a suspended ceiling with grid openings and ceiling panels. The system has a speaker support base capable of supporting at least one speaker within a ceiling opening without interfering with the operation of the speaker. A guide flange is integral to the speaker support base and is adapted to align at least a portion of a ceiling tile within the grid opening. A support flange having an offset at each end is integral to the system, connected to the guide flange, and supports at least a portion of the ceiling tile within the ceiling grid opening so that the opening is filled with the speaker support base and the remaining portion of the opening is filled with ceiling tile. The base and guide flange are formed from a single piece of material, which is perforated substantially to at least some of the edges thereof.

32 Claims, 11 Drawing Sheets

U.S. PATENT DOCUMENTS

| | | | | |
|---|---|---|---|---|
| 4,057,689 | A | 11/1977 | Stallings, Jr. | |
| 4,327,403 | A | 4/1982 | Capostagno et al. | |
| 4,330,691 | A | 5/1982 | Gordon | |
| 4,484,658 | A | 11/1984 | Grote | |
| 4,509,192 | A | 4/1985 | Straughn | |
| 4,727,587 | A | 2/1988 | Black | |
| 4,923,032 | A | 5/1990 | Nuernberger | |
| 5,009,383 | A | 4/1991 | Chapman | |
| 5,088,574 | A | 2/1992 | Kertesz, III | |
| 5,316,254 | A | 5/1994 | McCartha | |
| 5,533,306 | A | 7/1996 | Aspenson | |
| 6,807,780 | B2 | 10/2004 | McCahill et al. | |
| 7,120,269 | B2 * | 10/2006 | Lowell et al. | 381/386 |

OTHER PUBLICATIONS

Atlas Sound,; 1'+2' Drop-In Speaker Systems, Installs Hassle-Free; Atlas Sound Product Catalog; 2001.

* cited by examiner

LAY-IN TILE SPEAKER SYSTEM

CROSS-REFERENCE TO RELATED APPLICATION

This application is a continuation-in-part and claims priority of pending U.S. Ser. No. 09/972,465, filed Oct. 5, 2001.

BACKGROUND OF INVENTION

This invention relates generally to a loud speaker system and more particularly to a speaker support system for use in a new or existing conventional suspended ceiling, which system includes an integral t-shaped flange to thereby facilitate installation of the system.

Suspended ceilings are typically constructed of a suspended metal grid, the grid having ceiling grid openings into which acoustic tiles or panels are assembled to create the ceiling. Often it is desired to include a speaker system within the ceiling. The customary procedure for installing a speaker into an acoustic tile ceiling includes cutting a hole in a tile and mounting the speaker therein. This is a time consuming and often difficult procedure that results in the speaker being clearly visible in the ceiling.

Attempts have been made to provide alternative support systems. Unfortunately, due to the complexity of these systems, they tend to be costly to manufacture, complicated to assemble and thus timely and expensive to install. These systems often require multiple or intricate cuts to the ceiling tile and/or consist of multiple piece supports that must be assembled during installation.

It is therefore an object of the present invention to provide a loud speaker support system that is quickly and easily manufactured and installed into a new or existing suspended ceiling.

It is another object of the present invention to provide a speaker support system that can be easily adapted to mount a variety of speaker types and sizes including both music and paging systems, for example.

It is yet another object of the present invention to provide a speaker support system that is visually integrated into a new or existing suspended ceiling.

SUMMARY OF INVENTION

To accomplish the foregoing and other objects of the present invention there is provided a lay-in tile type of speaker support system for use with suspended ceilings. The system may support various sizes and types of speakers, such as foreground music, sound masking, or paging systems. The system includes a speaker support base that is perforated to improve acoustics by providing maximum free air space. The perforated surface also helps the appearance of the new system to visually blend in with the overall suspended ceiling in which the system is installed. The system further provides integral flanges that form a T-shaped member, when viewed in section, to support at least a portion of a ceiling tile cut to complete to ceiling grid opening. In one embodiment the base and the flanges are constructed from a single sheet of material that is folded to form the flanges. A preferably substantially solid support plate may be utilized to strengthen the base. When the support plate is utilized it is placed against the base and the speaker is mounted to the support plate. The speaker can be mounted with or without a back box. The base is sized to fit within at least a portion of a conventional ceiling tile grid opening, and has substantially ninety degree corners so that the ceiling grid opening is completed by a ceiling tile cut to size with a simple, straight cut.

In one embodiment the base occupies about one half of the ceiling grid opening and the cut ceiling tile completes the other half of the grid opening. In another embodiment the base occupies about one quarter of the ceiling grid opening and the cut ceiling tile occupies about three quarters of the ceiling grid opening. If desired, the new system can also be sized to fill a complete ceiling tile opening. So, it can be readily seen that the new system offers a great degree of flexibility to the art of ceiling speaker installation.

In another embodiment the base the flanges thereof are not all constructed from a single sheet. Rather the base is formed of a sheet of perforated material having four edges all bent in the same direction so as to extend upwardly when the base is disposed for use in a ceiling grid. One of the flanges, a support flange, is connected, for example by welding, riveting, screwing, gluing, for example with epoxy, or other similarly useful means to the guide flange, which has been formed of a section of L-bar or hemmed L-bar, for example, so that prior to installation the two flanges so rigidly connected together form an integral long edge to the base and having an upside down L shape with an offset at each end for fitting into the ceiling grid.

A lay-in tile type system is disclosed for supporting speakers in a new or existing suspended ceiling includes a perforated base section providing maximum free air space. A perforated surface also helps the lay-in tile system blend in with the overall suspended ceiling in which the system is installed. The system further provides integral flanges that form a T-shaped member (in section) to support at least a portion of an adjacent ceiling tile, obviating the need to purchase, cut and install a replacement grid member. The base and its side flanges are constructed from a single sheet of material that is folded to form the side flanges, with a section of L bar having an offset at each end and which is fixed to one long edge, adjacent an upstanding guide flange of the support base to guide the positioning of a piece of ceiling tile within a ceiling grid. The base is sized to fit within a portion of a conventional ceiling tile grid opening, and has substantially ninety degree corners so that the ceiling grid opening is completed by a ceiling tile sized with a simple straight cut, simplifying installation.

Thus, in view of the above objects and advantages, the invention is, briefly, a speaker support system adapted for use in a suspended ceiling with grid openings and ceiling panels. The system has a speaker support base capable of supporting at least one speaker within a ceiling opening without interfering with the operation of the speaker. A guide flange is integral to the speaker support base and is adapted to align at least a portion of a ceiling tile within the ceiling grid opening. A support flange preferably having an offset at each end is also integral to the system, and is contiguous with one side of the support base by being connected to the guide flange of the support base. The support flange supports at least a portion of the ceiling tile within the ceiling grid opening so that the opening is filled at least in part by the speaker support base and the remaining portion of the opening is filled with ceiling tile. The speaker support base and the guide flange are formed from a single piece of material, which is perforated substantially entirely to at least some of the edges thereof.

These and other objects and advantages will be in part apparent and in part pointed out herein below.

BRIEF DESCRIPTION OF THE DRAWINGS

Throughout the figures like elements are indicated by like numbers.

DETAILED DESCRIPTION OF PRACTICAL EMBODIMENTS

Figure 1:
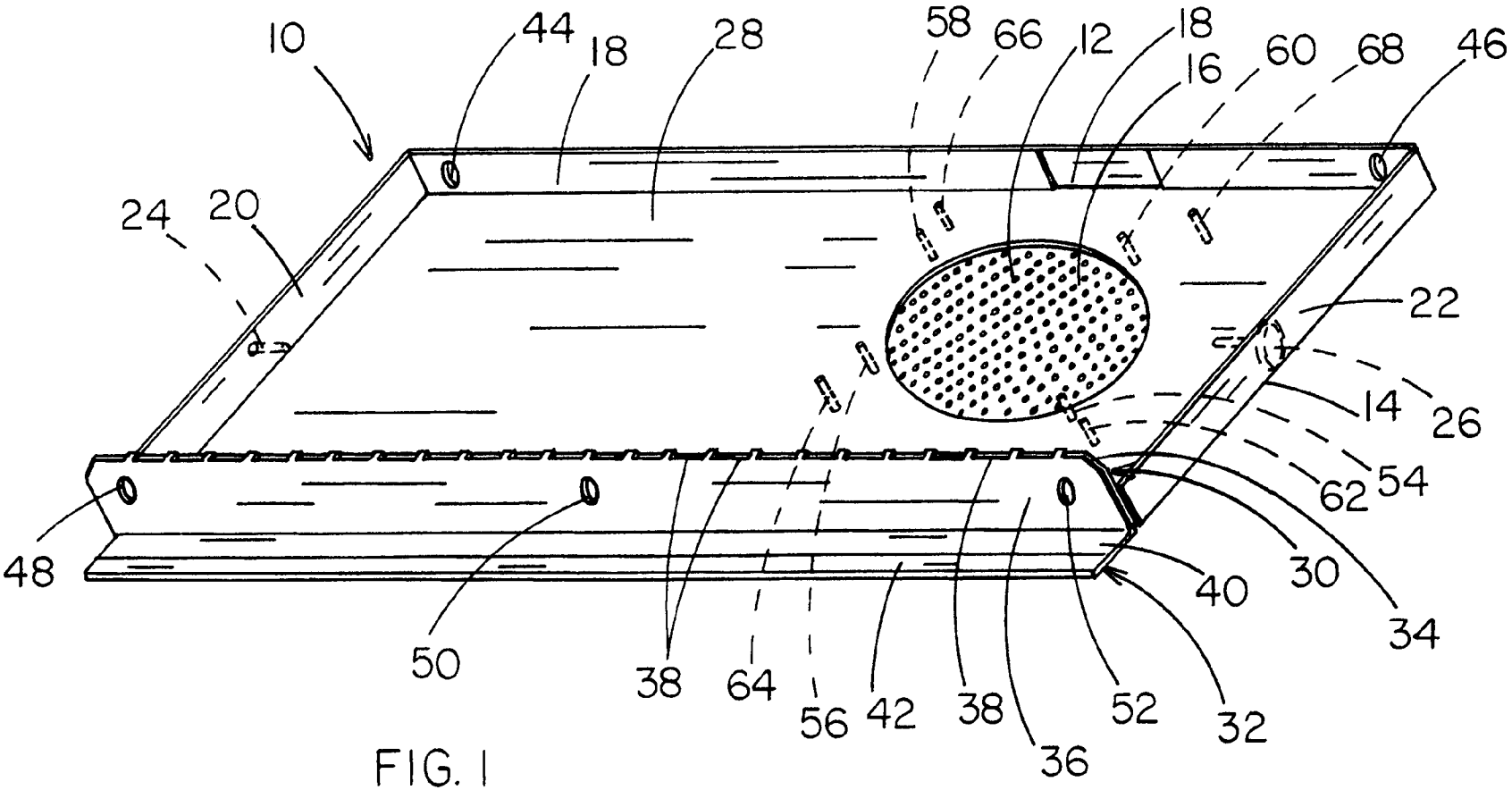
FIG. 1 is an upper perspective view of the speaker support system of the present invention illustrating the side of the system to which the speaker is normally mounted.
Figure 2:
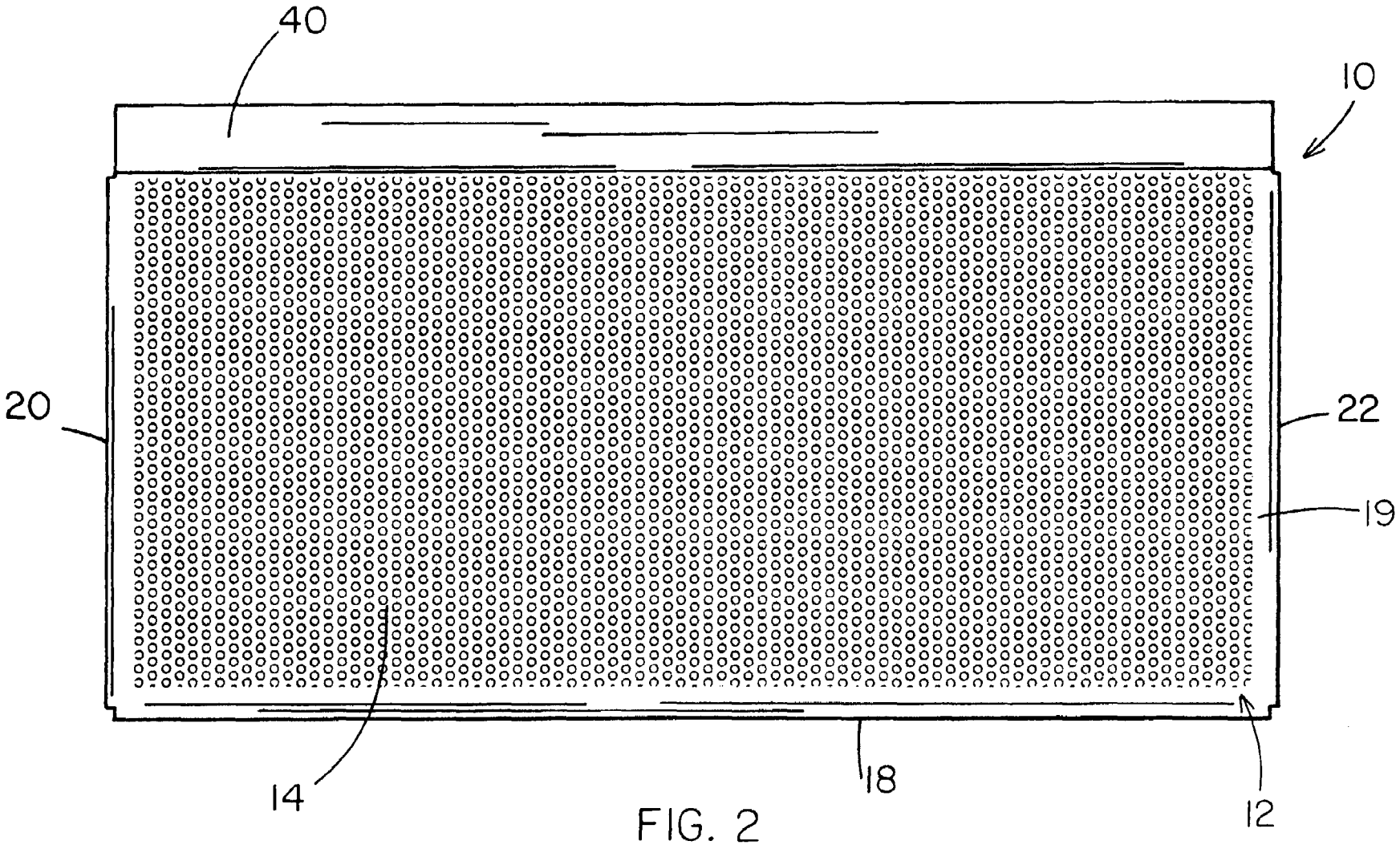
FIG. 2 is a plan view of the side of the system that is exposed when the system is in place in a ceiling.
Figure 3:
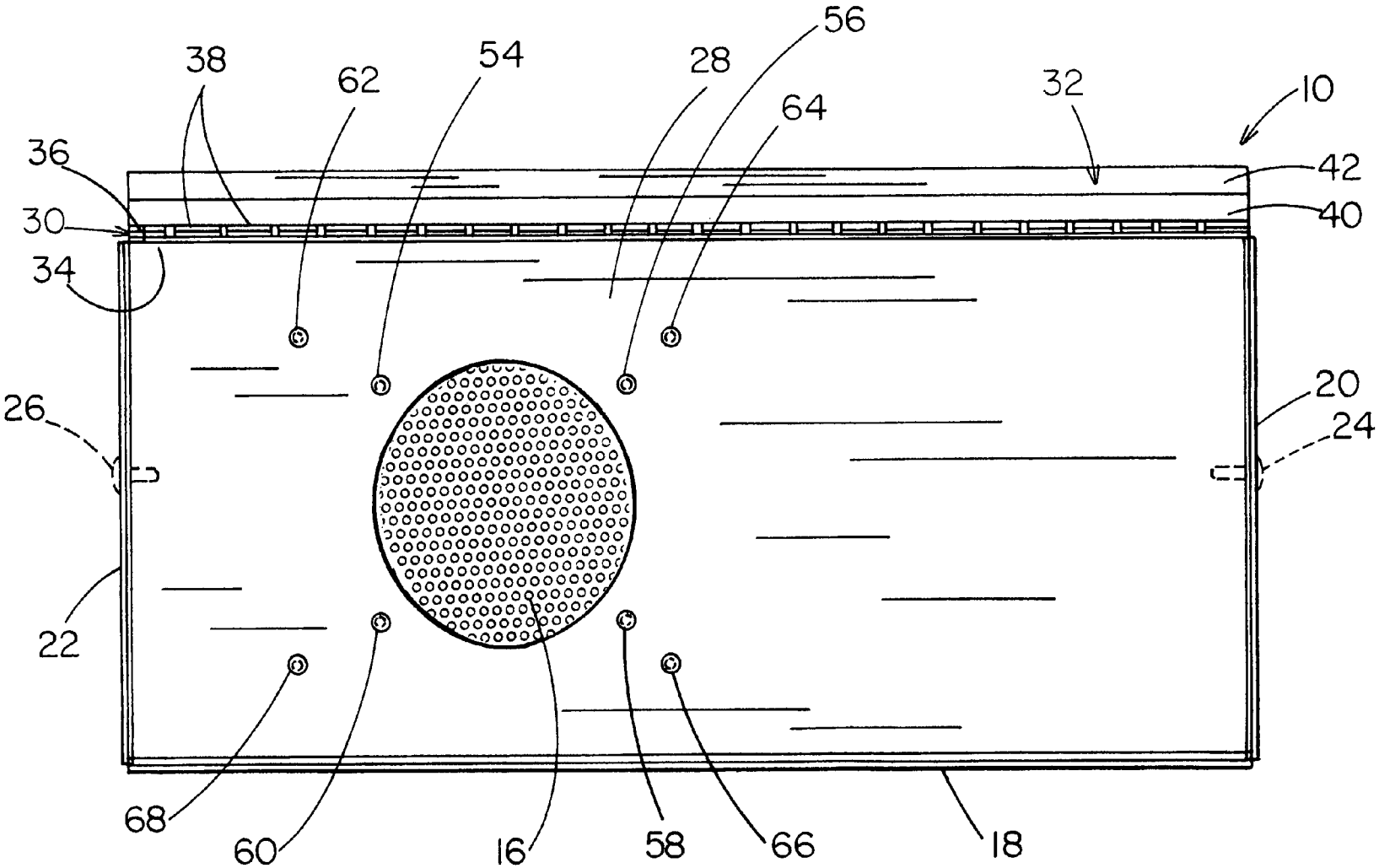
FIG. 3 is a top plan view of the system of FIG. 1.
Figure 4:
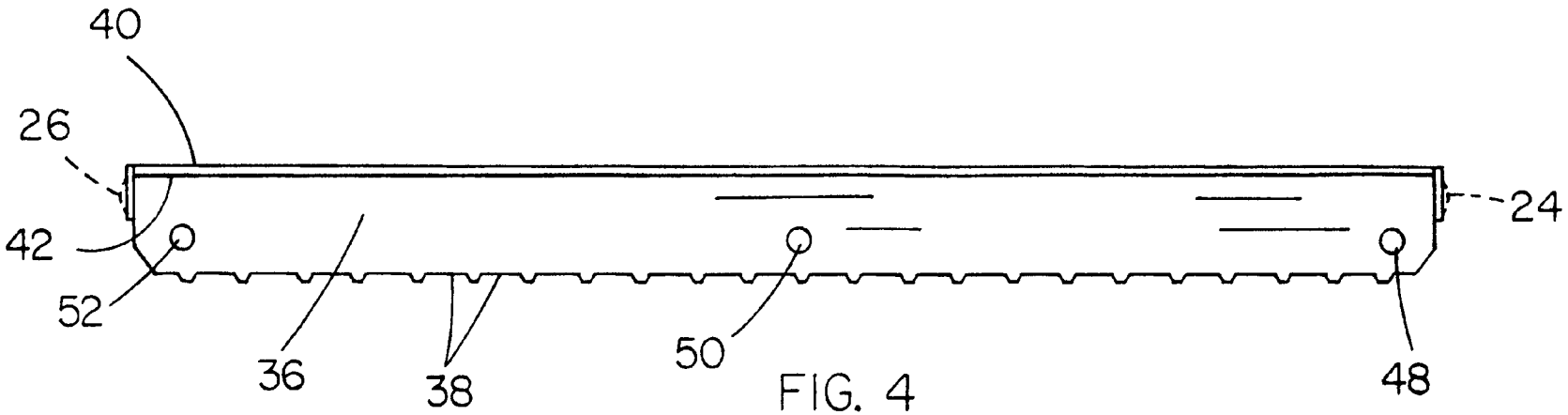
FIG. 4 is a side elevational view of the system of FIG. 1, taken from the front of FIG. 1 and inverted.
Figure 5:
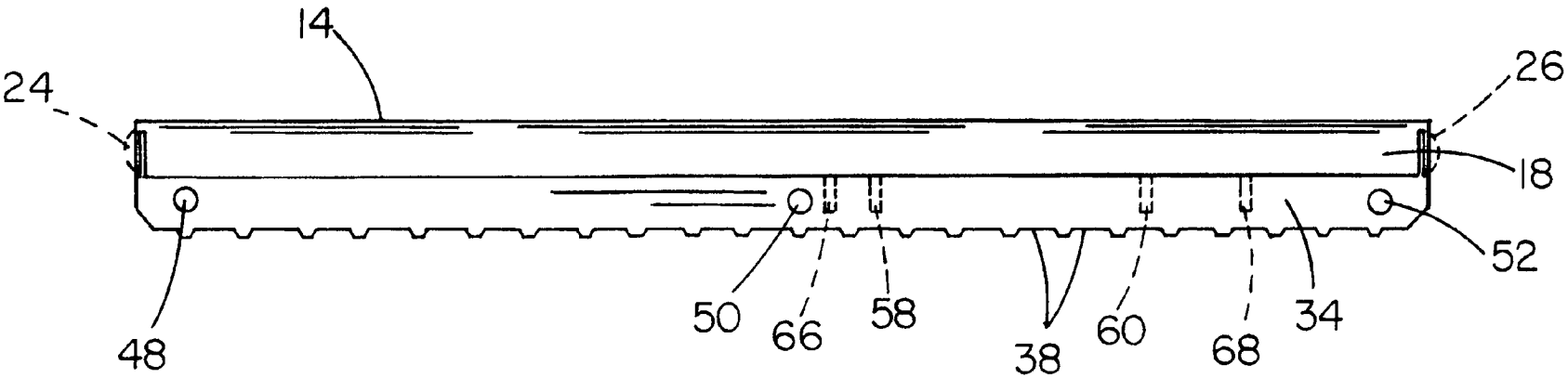
FIG. 5 is a side elevational view of the new system taken from the opposite side of FIG. 4.
Figure 6:
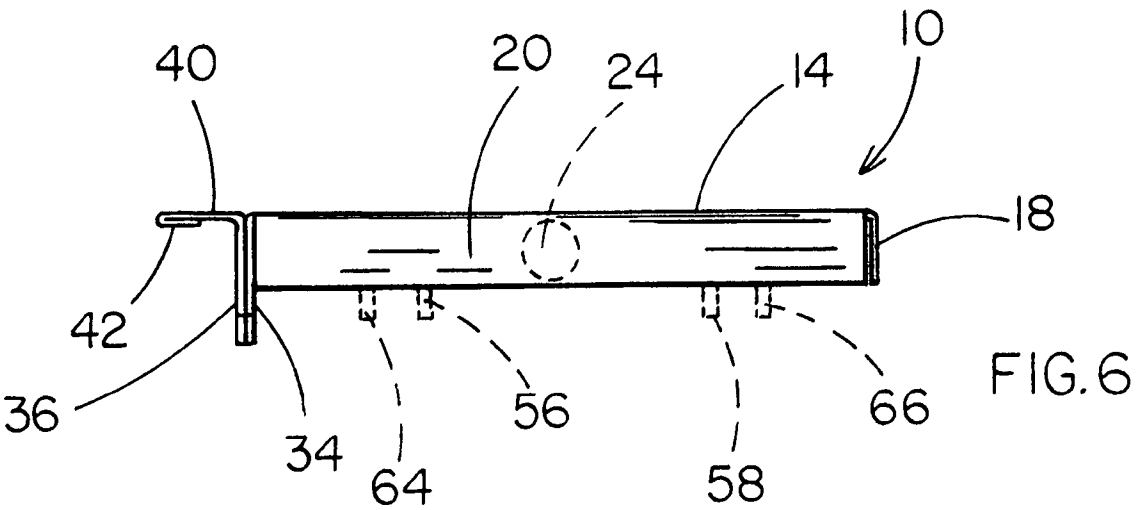
FIG. 6 is an end elevational view of the new system taken from the left of FIG. 2.
Figure 7:
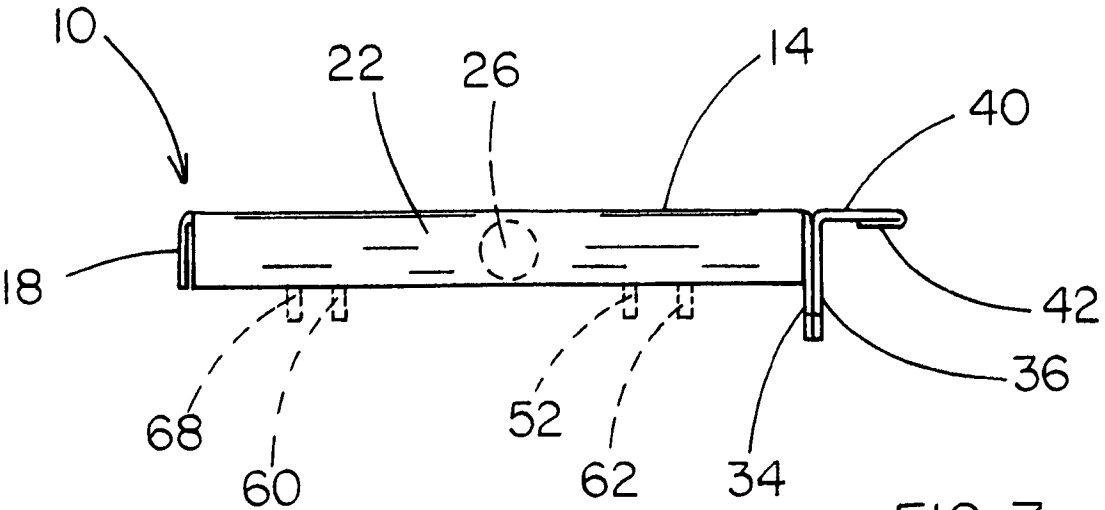
FIG. 7 is an end elevational view of the new system viewed from the right side of FIG. 6.
Figure 8:
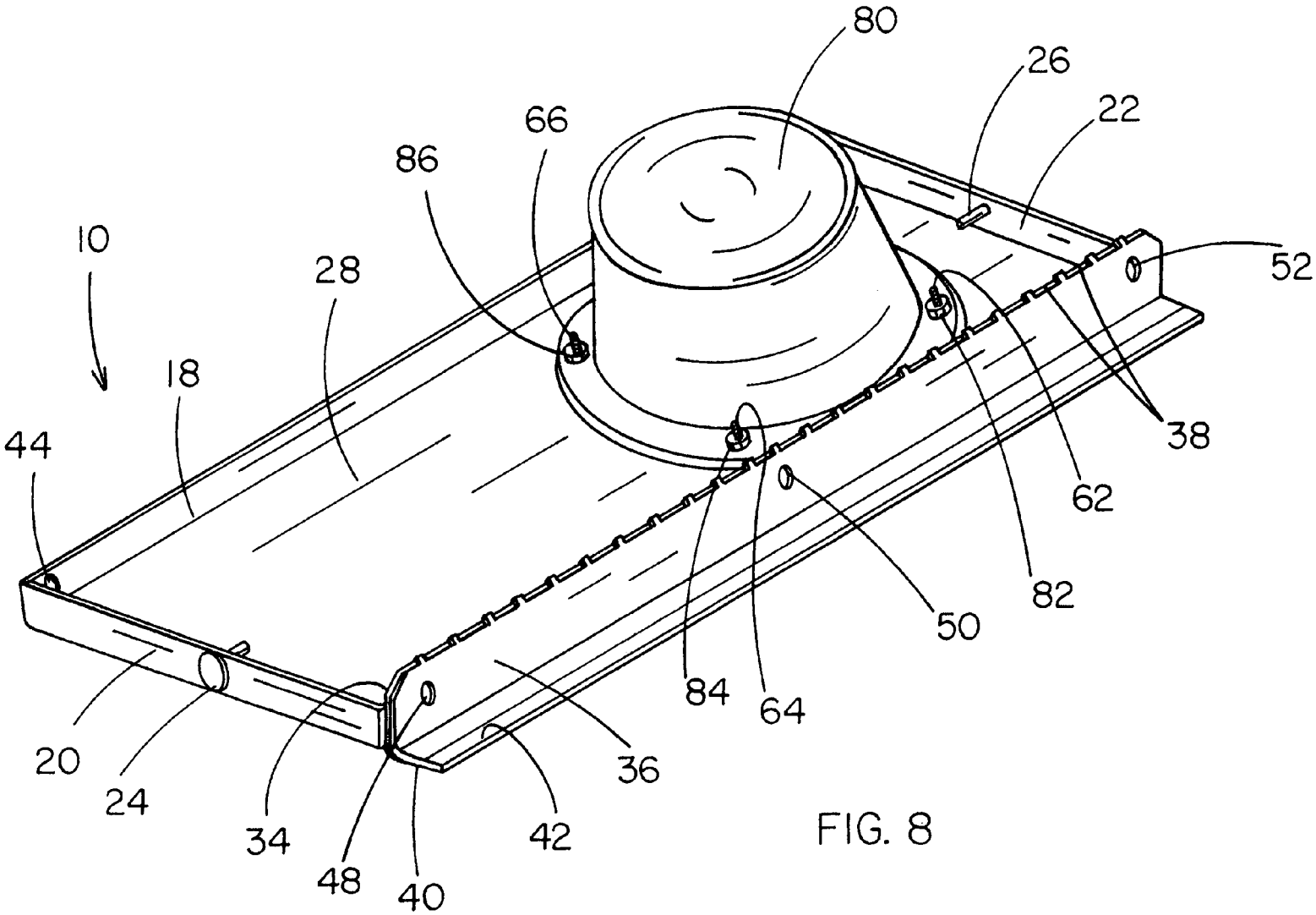
FIG. 8 is a perspective view of the system of FIG. 1 with a speaker back box mounted on the system.

With reference to FIGS. 1-10 there is shown a preferred embodiment of the speaker support system of the present invention generally designated 10. System 10 includes a speaker support base 12 of a material suitable for supporting a speaker, such as lightweight metal or polymer. Base 12 has a front side 14 that faces into the room when the system is installed, and a back side 16 onto which the speaker is secured. In a preferred embodiment, base 12 is sized one by two feet, in order to fill about one half of a two foot square ceiling grid opening or about one quarter of a two by four foot ceiling grid opening. Of course, any size can be provided as may be required for a particular ceiling structure, but the mentioned sizes are preferred for mass production. As is best illustrated in FIG. 2, support base 12 may be perforated, the fine perforations providing maximum free-air space for improved speaker sound transmission while visually integrating system 10 into the new or existing tile ceiling. In this embodiment base 12 is formed from a single piece of sheet material having the majority of the surface thereof filled with perforations, as indicated in FIG. 2, and significant solid border, e.g. as shown at 19, around at least some of the peripheral edges. As seen in FIG. 1, for example, projecting from support base 12 are flanges 18, 20, and 22 that are all un-perforated and increase the strength of system 10 and thus the stability thereof in normal use position. In the first illustrated embodiment these flanges are all integral to speaker support base 12 in the sense that they are all formed of a single piece of material and thus are secured to one another as a single unit for supporting a speaker within a ceiling. Flanges 20 and 22 include pins 24 and 26 or other suitable fasteners that may be added to secure a support plate 28 to base 12.

System 10 further includes a guide flange generally designated 30 and a support flange generally designated 32. In use position guide flange 30 is disposed substantially vertically and support flange 32 is disposed substantially horizontally. When viewed in vertical section, flanges 30 and 32 together form an integral generally T-shaped (upside down) ceiling tile support. In the end view of FIG. 7 the formation is more of an inverted L. In the first illustrated embodiment, base 12 and flanges 30, 32 are formed from a single sheet of material, preferably a lightweight metal or suitable polymer. Guide flange 30 is formed by folding the material to a substantially 90° angle to form an ascending (when system 10 is positioned in then normal use position shown e.g. in FIGS. 1 and 10) flange section 34 and then folding the material back upon itself to form a descending flange section 36. A plurality of slots 38 are preferably formed into the material prior to folding to facilitate construction without weakening the system.

Support flange 32 includes a support section 40 that intersects and is transverse to flange section 36 and is substantially planar with base 12 and a reinforcement strip 42. In the first embodiment shown in FIGS. 1-10, flanges 18 and 30 include holes 44, 46, 46 and 48, 50, 52 respectively. These holes allow system 10 to be wired or otherwise secured to the building if desired or if required by code.

Figure 9:
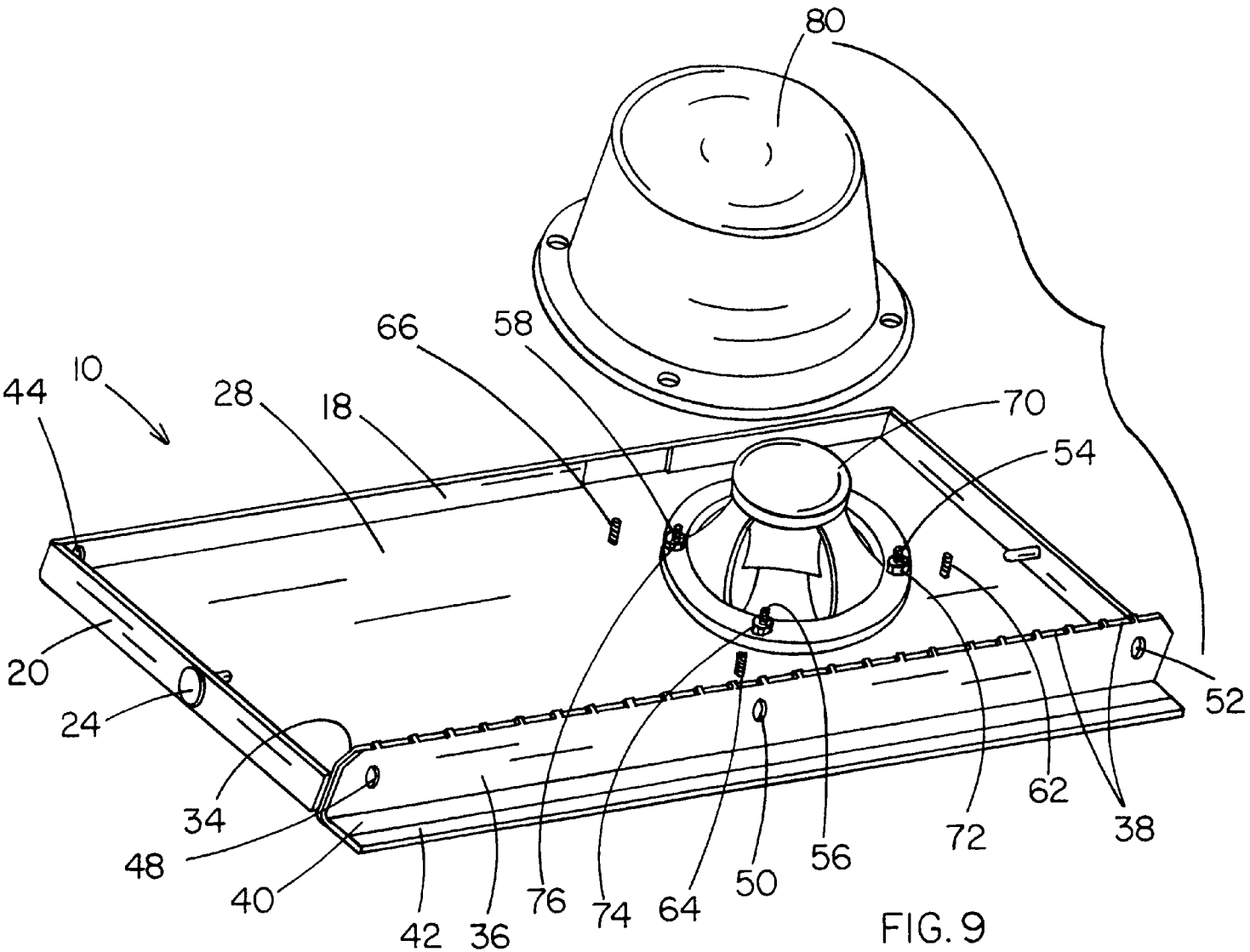
FIG. 9 is an exploded view of the system of FIG. 8, showing a speaker mounted directly to the upper surface of a support plate on the base of the system in normal use position.

Plate 28 provides a solid surface for the installation of one or more speakers, for example 8" coaxial, 8" dual cone, or 4" high compliance driver with 70V or 25/70V transformer. Plate 28 includes speaker anchoring bolts 54, 56, 58 and 60 and back box anchoring bolts 62, 64, 66 and 68. As is illustrated in FIG. 9, a speaker 70 is mounted to plate 28 at the bolts and secured in place with nuts 72, 74, 76 and 78 (not shown). A back box 80 is optionally mounted over the speaker 70 and secured by nuts 82, 84, 86 and 88 (not shown).

Figure 10:
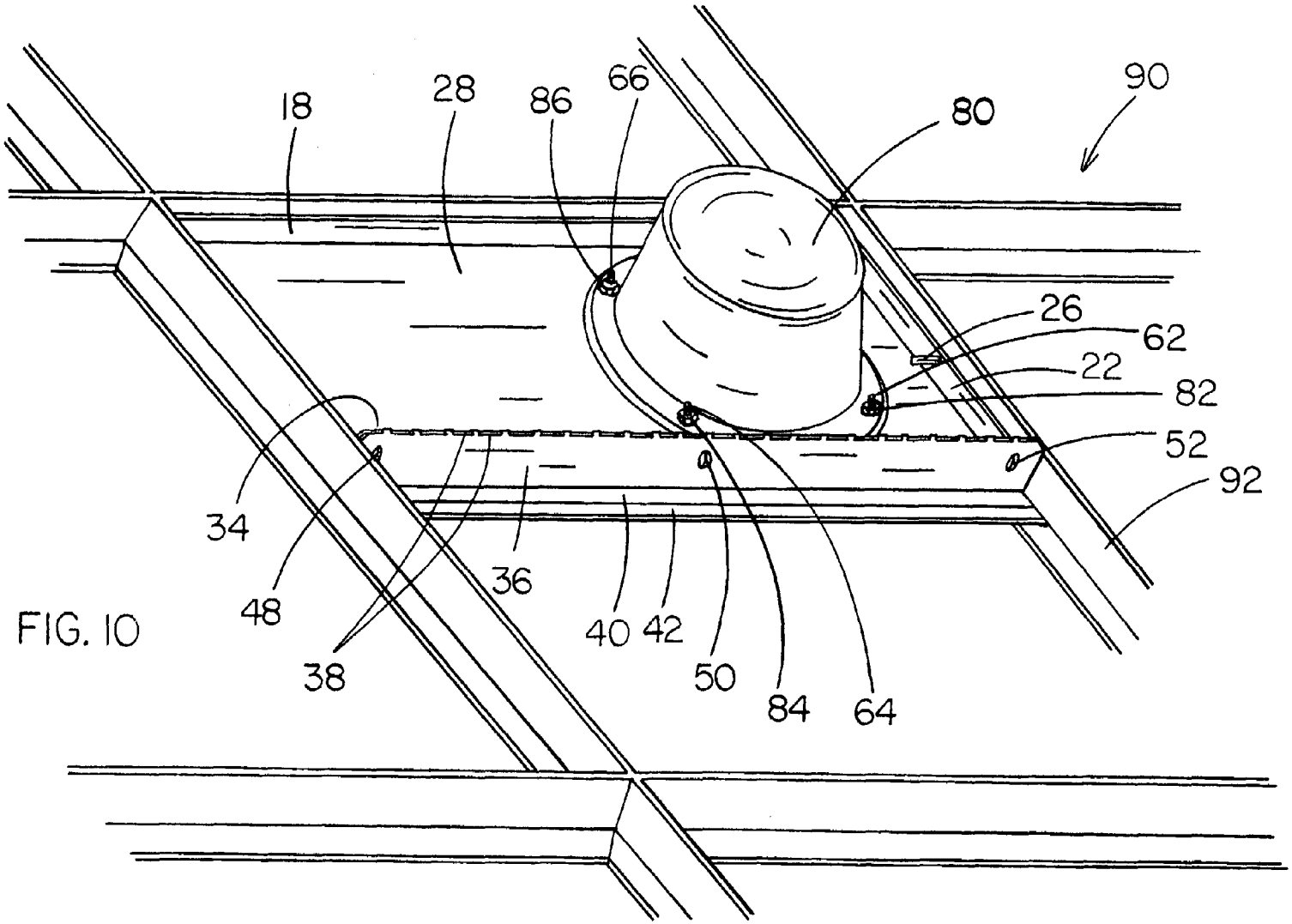
FIG. 10 is a perspective view of the system of FIG. 8 assembled onto an area of suspended ceiling grid, with a section of ceiling tile shown in place, broken away, to illustrate how such tiles are supported within the ceiling adjacent the new system.

System 10 is shown in FIG. 10 installed into a standard two by two foot grid opening of a suspended ceiling, generally designated 90, the ceiling having T-shaped supports 92 onto which the ceiling tiles (not shown) are installed. The integral flanges 30, 32 create a T-shaped support compatible with ceiling 90. Only a simple straight cut is required to size a ceiling panel to complete the grid opening onto which system 10 is installed.

Figure 11:
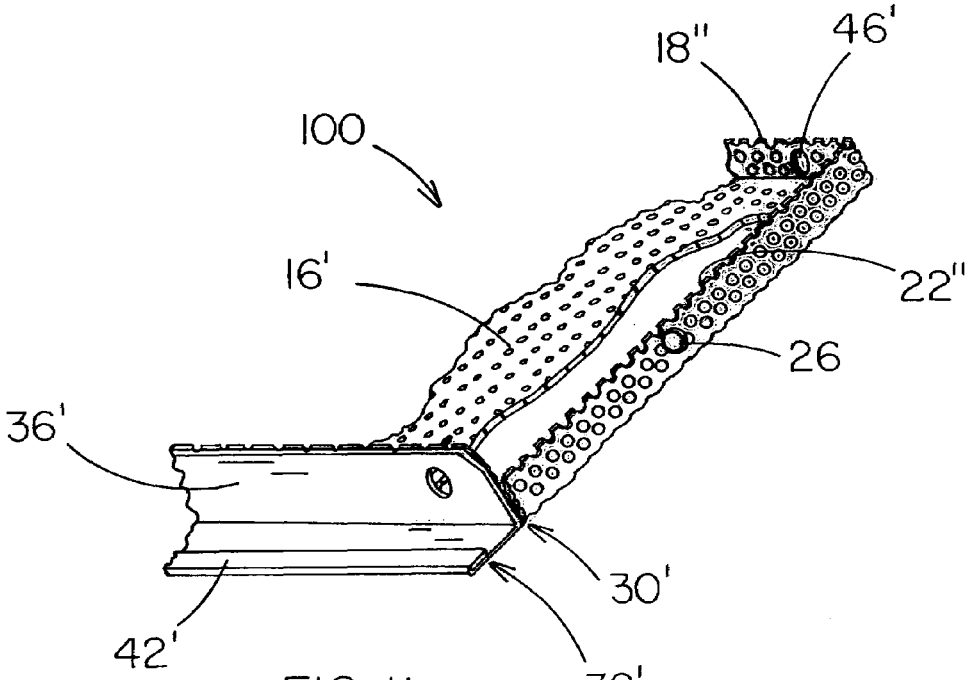
FIG. 11 is a perspective view, partially broken away of another embodiment of the lay-in tile speaker support system of FIG. 1, showing the edge construction of the base plate and a connected guide flange.
Figure 12:
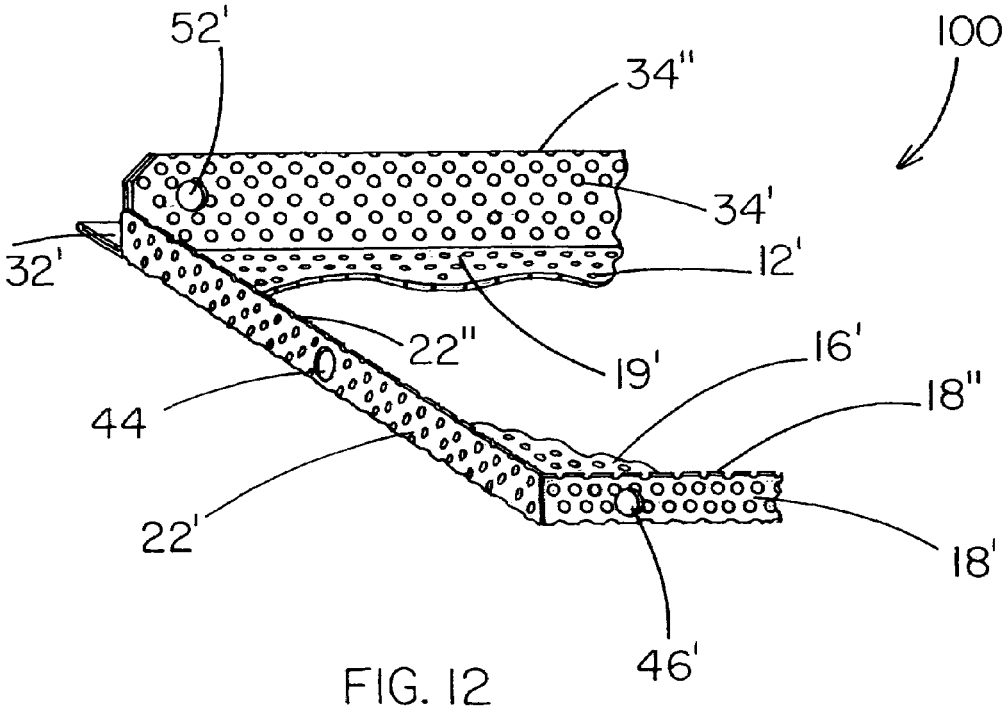
FIG. 12 is a perspective view, partially broken away of the system of FIG. 11, showing the base plate flange construction for connection to the guide flange.
Figure 13:
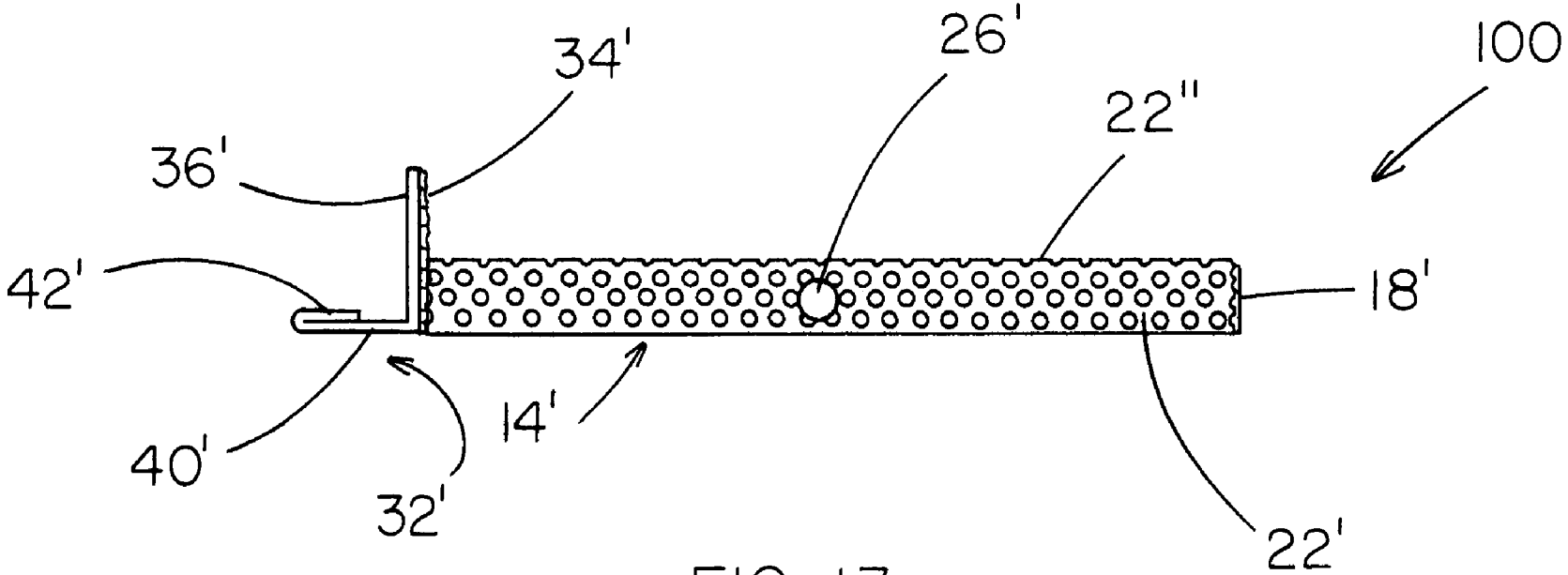
FIG. 13 is an end elevational view of the system of FIG. 11 taken from the right side of FIG. 11, the opposite end being a mirror image thereof.

FIGS. 11, 12 and 13 illustrate a further embodiment of the new speaker support system generally designated 100, which system 100 functions generally the same way and has similar advantages to the embodiment described above, but which varies slightly in its construction. Other than as described below, the second illustrated embodiment is, for the most part, formed and used in substantially the same manner as the first. Thus, elements of the embodiment of FIGS. 11-13 that are the same or provide the same overall structural role as those of the embodiment of FIGS. 1-10 are provided with the same element number, but with the additional prime (') symbol. The main difference in the second embodiment shown is that the speaker support base 12' is formed of a sheet of material which is entirely or nearly entirely perforated, rather than material that is only centrally perforated but solid around its periphery, as in the first shown embodiment. This provides a great savings in time of manufacture and materials.

Thus, the base support 12' of speaker support system 100 is perforated over the entire area thereof, including the side flanges 18', 20' and 22'. That is, a sheet of material which is perforated over essentially the entire area thereof is utilized to form speaker support base 12', including all of its edges, which are bent up to form flanges on all sides of the base, all edges projecting in the same direction, as in the first shown embodiment. Thus, boarder area 19', seen in FIG. 12, is perforated, rather than solid, as in the first embodiment. However, the very external periphery of the sheet material of the second embodiment, (e.g. as indicated at 18", 22" and 34") may have a very thin solid (un-perforated) border (not shown), e.g. about ⅛ to about ¼ of an inch, more or less, on one or more edges. Such a construction would still be considered within the parameters of this second embodiment and may be necessary for manufacture of the sheet material.

While support flange 32' is still preferably formed of solid (i.e., unperforated) material (such as, for example, a section of L-bar or hemmed L-bar), for strength, it is rigidly connected, for example, via spot welding, rivets, screws, epoxy glue, or other suitable means along the length of vertically disposed (in use) length 36' to a contiguous length of a flange ascending section 34' of perforated guide flange 30'. Vertically disposed length 36' replaces the flange descending section 36 which is solid and folded over in the first embodiment to lay flat against ascending section 34'. In this latter embodiment, sections 34' and 36' are still substantially rigidly connected to one another, preferably by welding along the entire respective lengths thereof. Strength is added in this embodiment also by having a flange reinforcing strip 42' preferably along the entire outer length of horizontal flange section 40', which section 40' serves as a shelf to hold a ceiling tile edge.

In FIGS. 11 and 12 the upper surface 16' of base 12' is illustrated, partially broken away. It is to be understood that a support plate (not shown in this embodiment), such as that previously illustrated and indicated at 28 can and usually will be used on top of surface 16', just as in the previous embodiment, to add strength to the entire system and to further support the weight of a speaker mounted on the new system 100.

As in the first illustrated embodiment, flange holes, e.g. 46', can be provided centrally or at other pre-selected points along the lengths of the various flanges 18', 20' and 22' to receive connectors, such as pins 26, for example, to facilitate securing speaker support base 12' to an adjacent ceiling support grid section. System 100 can otherwise be formed at least in all of the various alternative shapes and sized described with respect to the first illustrated embodiment.

Figure 14:
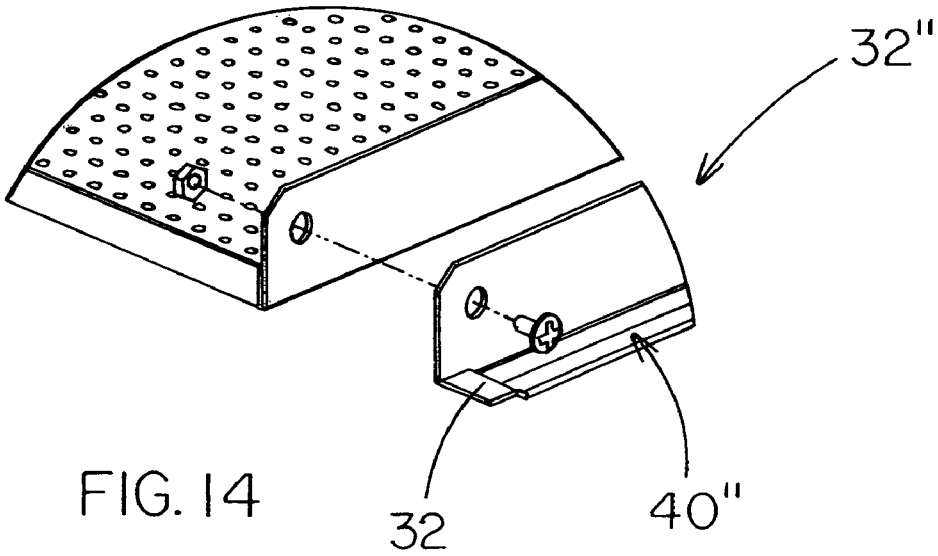
FIG. 14 is an enlarged partial view of a corner of a preferred alternative of the system of FIG. 1 showing an off-set of the ends of the support flange to enhance the fit of the system within a ceiling grid.

FIG. 14 illustrates in enlarged section an alternative and especially preferred form of the support flange 42", of the new speaker support system. Flange 42" has an area 37, which is slightly off-set from the plane of the support flange support section 40". Off-set style flange 42" may be used in any of the above-described embodiments of the speaker support system, which remain unchanged in all other respects. In order to enhance the fit of system 10, 100 in a ceiling grid, when the new speaker support system is in normal use position in a ceiling grid, off-set areas 37 of the support flange lie in a plane slightly above the plane of the support flange support section 40" and the system support base 12, 12', which are otherwise substantially coplanar.

Figure 15:
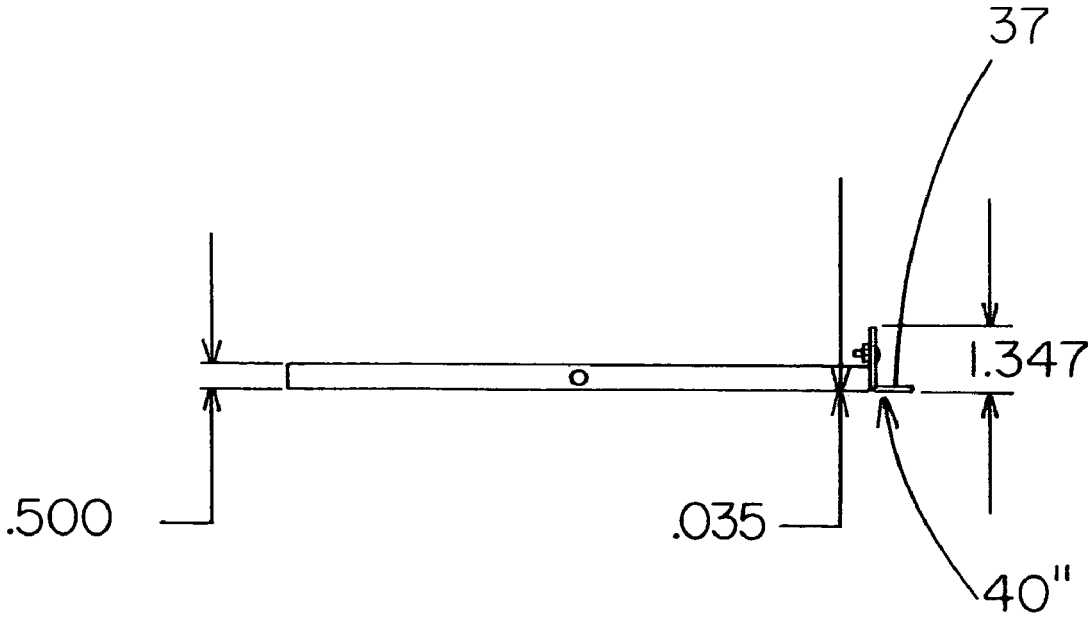
FIG. 15 is a schematic end view of the embodiment illustrated in FIG. 14, showing that the support flange is coplanar with the base of the system and the off-set area at the end of the support flange is in a plane substantially parallel to and above the plane of the rest of the support flange and the base.

FIG. 15 shows that the support flange 42" is substantially coplanar with the base 12, 12'of the system and the off-set area at the end of the support flange is in a plane substantially parallel to and above the plane of the rest of the support flange and the base, in normal ceiling installed use position.

From the foregoing description those skilled in the art will appreciate that all of the objects of the present invention are realized. A speaker support system that is quickly and easily manufactured and installed into a new or existing suspended ceiling is provided. The system provides an integral ceiling tile support eliminating the need to purchase, cut, and install a replacement grid member to support the adjacent tile, and is visually and securely integrated into the ceiling. In addition, the system can be easily adapted to mount a variety of speaker sizes and types including foreground music, paging and sound masking systems.

Having described the present invention in detail, those skilled in the art will appreciate that modifications may be made of the present invention without departing from its spirit and scope. For example, the base size of about one by two feet is preferred, however the base may be sized to fit any ceiling grid opening or for use in any application. Likewise the system may be constructed of any material suitable for supporting the speaker without interfering with the speaker operation.

While the illustrated number and location of the bolts to secure the speaker is preferred, it is understood that any number and configuration, or any other means of securing the speaker and back box may be utilized. In addition, the holes in the flanges to secure the system to the building may vary in number and location, or any conventional means of securing known in the art may be utilized without affecting system operation. Finally, it is noted that while the system is shown with one speaker mounted off center, the number and location of the speakers may be varied to meet a particular application.

In view of the foregoing, it will be seen that the several objects of the invention are achieved and other advantages are attained. Although the foregoing includes a description of the best mode contemplated for carrying out the invention, various modifications are conceivable.

Therefore, it is not intended that the scope of the present invention be limited to the specific examples and embodiments described herein. It is also contemplated that other modifications and applications, or equivalents thereof, will occur to those skilled in the art. It is accordingly intended that the claims set forth below shall cover all such changes, modifications, variations and other uses and applications that do not depart from the spirit and scope of the present invention as described herein.

Other aspects, objects and advantages of the present invention can be obtained from a study of the disclosure and the appended claims.

What is claimed is:

1. A speaker support system adapted for use with a suspended ceiling of the type having a suspended ceiling grid including a plurality of ceiling grid openings and a plurality of ceiling panels sized to fit within the ceiling grid openings, the speaker supports system comprising:

a speaker support base adapted to support at least one speaker within a ceiling grid opening without interfering with the operation of the speaker;

a guide flange integral to the speaker support base, the guide flange being adapted to align at least a portion of a ceiling tile within the ceiling grid opening; and an integral support flange connected to the guide flange along at least a portion of the extent thereof and adapted to support at least a portion of the ceiling tile within the ceiling grid opening so that at least a portion of the ceiling grid opening is filled with the speaker support base and the remaining portion of the ceiling grid opening is filled with ceiling tile;

wherein the speaker support base and the guide flange are formed from a single piece of material having a plurality of edges and which is perforated substantially entirely to at least some of the edges thereof.

2. The speaker support system of claim 1, wherein the support flange is formed of a section of substantially solid material.

3. The speaker support system of claim 1, wherein the support flange has two opposed ends and an off-set area at each of the two opposed ends to thereby enhance the fit of the speaker support system into a suspended ceiling grid.

4. The speaker support system of claim 1, wherein the support flange is rigidly connected to the guide flange.

5. The speaker support system of claim 4, wherein the support flange is welded to the guide flange.

6. The speaker support system of claim 1, and further including a support plate mounted to the speaker support base to strengthen the speaker support base.

7. The speaker support system of claim 1, wherein the piece of material forming the support base and the guide flange has a solid border on at least one edge thereof.

8. The speaker support system of claim 1, and further including at least one speaker back box mounted on the speaker support base.

9. The speaker support system of claim 1, wherein the speaker support base fills about a first half of the ceiling grid opening and the ceiling tile fills about the second half of the ceiling grid opening.

10. The speaker support system of claim 1, wherein the speaker support base fills about three quarters of the ceiling grid opening and the ceiling tile fills about one quarter of the ceiling grid opening.

11. A speaker support system adapted for use with a suspended ceiling of the type having a suspended ceiling grid including a plurality of ceiling grid openings and a plurality of ceiling panels sized to fit within the ceiling grid openings, the speaker supports system comprising:

a speaker support base adapted support at least one speaker within a ceiling grid opening without interfering with the operation of the speaker;

a plate mounted to the speaker support base to strengthen the speaker support base;

a guide flange integral to the speaker support base, the guide flange being adapted to align at least a portion of a ceiling tile within the ceiling grid opening; and an integral support flange connected to the guide flange along at least a portion of the extent thereof and adapted to support at least a portion of the ceiling tile within the ceiling grid opening, so that at least a portion of the veiling grid opening is filled with the speaker support base and the remaining portion of the ceiling grid opening is filled with ceiling tile;

wherein the speaker support base and the guide flange are formed from a single piece of material having a plurality of edges and which is perforated substantially entirely to at least some of the edges thereof.

12. The speaker support system of claim 11, wherein the support flange is formed of a section of solid material.

13. The speaker support system of claim 11, wherein the support flange is rigidly connect to the guide flange.

14. The speaker support system of claim 13, wherein the support flange is welded to the guide flange.

15. The speaker support system of claim 11, wherein the support flange has two opposed ends and an off-set area at each of the two opposed ends to thereby enhance the fit of the speaker support system into a suspended ceiling grid.

16. The speaker support system of claim 11, wherein the piece of material forming the support base and the guide flange has a solid border on at least one edge thereof.

17. The speaker support system of claim 11, and further including at least one speaker mounted on the speaker support base.

18. The speaker support system of claim 11, wherein the speaker support base fills about a first half of the ceiling grid opening and the ceiling tile fills about the second half of the ceiling grid opening.

19. The speaker support system of claim 11, wherein the speaker support base fills about three quarters of the ceiling grid opening and the ceiling tile fills about one quarter of the ceiling grid opening.

20. A speaker support system adapted for use with a suspended ceiling of the type having a suspended ceiling grid including a plurality of ceiling grid openings and a plurality of ceiling panels sized to fit within the ceiling grid openings, the speaker supports system comprising:

a speaker support base adapted to support at least one speaker in alignment with the ceiling grid opening without interfering with the operation of the speaker;

a guide flange integral to the speaker support base, the guide flange being adapted to align at least a portion of a ceiling tile within the ceiling grid opening;

an integral support flange connected to the guide flange along at least a portion of the extent thereof and adapted to support at least a portion of the ceiling tile within the ceiling grid opening, the speaker support base and the guide flange being formed from a single sheet of material which is perforated substantially entirely to at last some of the edges thereof, and an integral support flange connected to the guide flange so that at least a portion of the ceiling grid opening is filled with the speaker support base and the remaining portion of the ceiling grid opening is filled with ceiling tile; and a plate disposed adjacent and parallel to the speaker support base to thereby strengthen the speaker support base.

21. The speaker support system of claim 20, wherein the flange is formed of a section of solid material.

22. The speaker support system of claim 20, wherein the support flange is formed of a section of L-bar.

23. The speaker support system of claim 22, wherein the support flange has two opposed ends and an off-set area at each of the two opposed ends to thereby enhance the fit of the speaker support system into a suspended ceiling grid.

24. The speaker support system of claim 20, wherein the support flange is rigidly connected to the guide flange.

25. The speaker support system of claim 20, wherein the support flange is welded to the guide flange.

26. The speaker support system of claim 20, wherein the speaker support system base is formed of a sheet of material having a plurality of edges and which is perforated substantially entirely to at least some of the edges thereof.

27. The speaker support system of claim 20, wherein the support plate includes an aperture and the speaker support system base is perforated wit a plurality of closely spaced apart perforations in an area in alignment with the aperture in the plate to thereby provide a site for position of a speaker on the speaker support system which position permits free passage of sound from the speaker through the speaker support system.

28. The speaker support system of claim 20, wherein the piece of material forming the support base and the guide flange has a solid border on at least one edge thereof.

29. The speaker support system of claim 20, wherein the speaker support base fills about a first half of the ceiling tile opening and the ceiling tile fills about the second half of the ceiling grid opening.

30. The speaker support system of claim 2, wherein the speaker support base fills about three quarters of the ceiling grid opening and the ceiling tile fills about one quarter of the ceiling grid opening.

31. The speaker support system of claim 20, and further including at least one speaker mounted to the support plate.

32. A method of mounting a speaker within a suspended ceiling grid having a plurality of ceiling grid openings and a plurality of ceiling panels sized to fit within the ceiling grid openings, the method comprising:

(a) providing a speaker support system having;

a speaker support base adapted to support at least one speaker within a ceiling grid opening without interfering with the operation of the speaker;

a guide flange integral to the speaker support base, the guide flange being adapted to align at last a portion of an adjacent ceiling tile within the ceiling grid opening; and an integral support flange connected to the guide flange along at least a portion of the extend thereof and adapted to support at least a portion of the ceiling tile within the ceiling grid opening so that at least a portion of the ceiling grid opening is filled with the speaker support base and the remaining portion of the ceiling grid opening is filled with ceiling tile; wherein the speaker support base and the guide flange are formed from a single piece of material having a plurality of edges and which is perforated substantially entirely to at least some of the edges thereof;

(b) positioning a speaker on the speaker support system to that the opening of the speaker faces downwardly when the speaker support system is positioned within the ceiling gild;

(c) positioning the speaker support system and the speaker thereon within a ceiling grid opening by using the guide flange to align the speaker support system and at least a portion of an adjacent ceiling tile within the ceiling grid opening; and (d) supporting the adjacent at least a portion of veiling tile in position next to the speaker support system on the support flange of the speaker support system.

* * * * *